US005480210A

United States Patent [19]

Lehenbauer et al.

[11] Patent Number: 5,480,210

[45] Date of Patent: Jan. 2, 1996

[54] ROTATING BABY CHAIR

[76] Inventors: Therese T. Lehenbauer; Steven C. Lehenbauer, both of 324 Chynoweth Ave., San Jose, Calif. 95136

[21] Appl. No.: 385,575

[22] Filed: Feb. 7, 1995

Related U.S. Application Data

[63] Continuation of Ser. No. 214,113, Mar. 17, 1994, abandoned.

[51] Int. Cl.[6] ..... A47D 1/00

[52] U.S. Cl. ..... 297/137; 297/344.26

[58] Field of Search ..... 297/5, 137, 344.21, 297/344.26; 472/15

[56] References Cited

U.S. PATENT DOCUMENTS

| | | | |
|---|---|---|---|
| 428,452 | 5/1890 | Burkholder | 297/137 |
| 432,378 | 7/1890 | Davidson et al. | 297/137 X |
| 2,481,725 | 9/1949 | Culley et al. | 297/137 |
| 2,631,651 | 3/1953 | Boysel | 297/344.21 X |
| 4,743,008 | 5/1988 | Fermaglich et al. | 297/137 X |
| 4,781,412 | 11/1988 | Holman . | |
| 4,971,392 | 11/1990 | Young . | |
| 5,050,862 | 9/1991 | Saghafi . | |
| 5,097,545 | 3/1992 | Hooi . | |
| 5,131,719 | 7/1992 | Kassai . | |
| 5,211,607 | 5/1993 | Fermaglish et al. | 472/15 |

FOREIGN PATENT DOCUMENTS

| | | | |
|---|---|---|---|
| 2306660 | 11/1976 | France | 472/15 |

*Primary Examiner*—Peter R. Brown

[57] ABSTRACT

A baby chair has an upper section to which a sling seat hangs and a lower base section to which legs are mounted in a tripod like construction, the upper section being able to rotate with respect to the lower base section and attached legs. The chair does not have wheels and thus while a child in the seat can spin himself (or herself) around to look in any direction, the child cannot move anywhere and since the legs are constructed to be angled out widely, there is no chance of the chair flipping over. A circular tray mounted around the perimeter of the upper section of the chair can be used to hold food and/or toys.

7 Claims, 4 Drawing Sheets

FIG 3
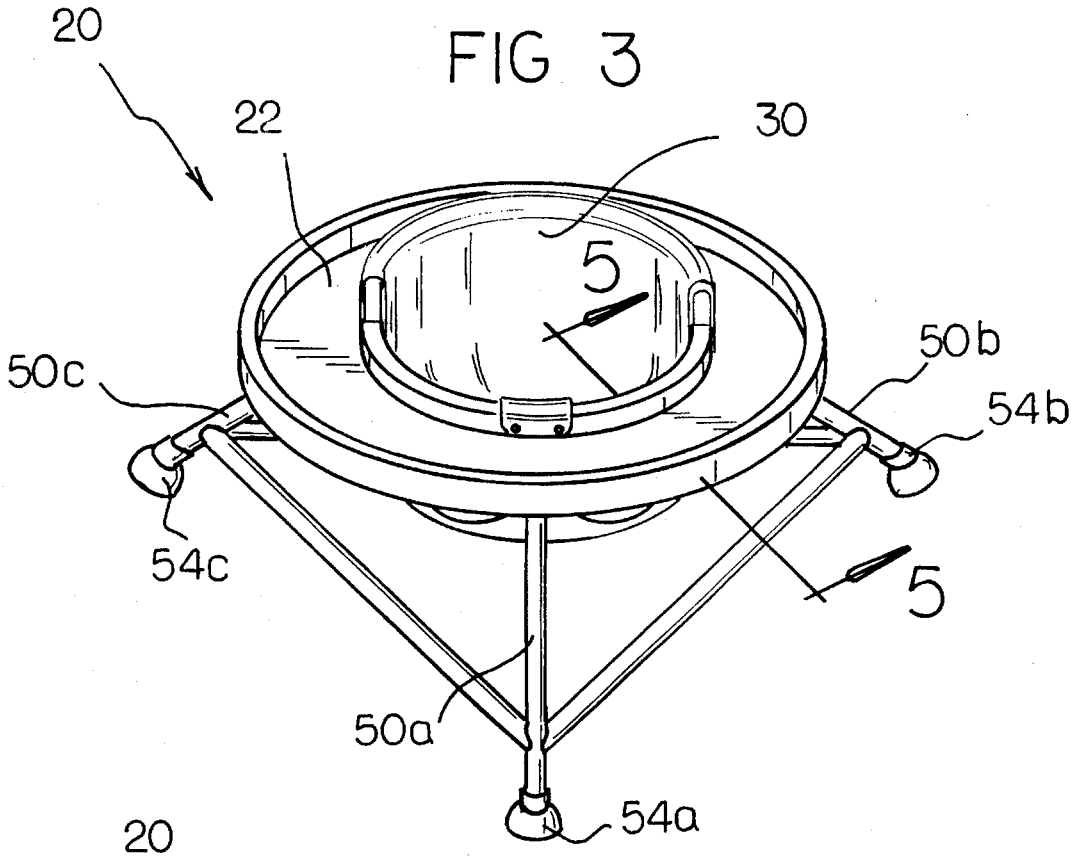
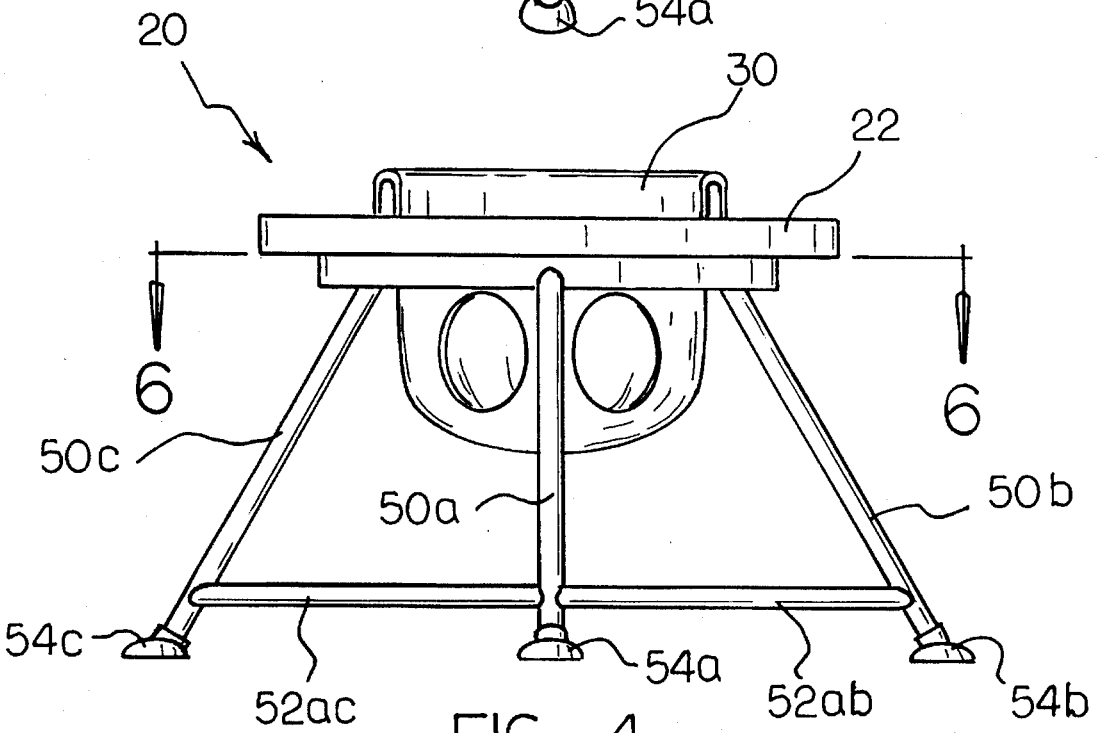
FIG 4

ROTATING BABY CHAIR

This application is a continuation of application Ser. No. 08/214,113, filed Mar. 17, 1994, now abandoned.

BACKGROUND OF THE INVENTION

1. Field of the Invention

The present invention relates generally to baby restraining devices, and more particularly, to a baby chair especially adapted to allow a child to spin around to face in any direction.

2. Description of the Prior Art

It is well known that babies are very curious. Baby walking devices have been used recently to allow babies to move themselves around. Unfortunately, these walking devices have been known to flip over and, also, children have been known to dangerously move themselves away from their parents. Thus the prior art baby walking devices require virtually constant parental supervision of the child. An example of one such prior art walking device is shown in U.S. Pat. No. 5,050,862.

It is also known in the prior art to provide restraining chairs and cradles for babies which hold the babies in a fixed position (see for example U.S. Pat. No. 5,097,545 and also FIG. 2 of the present application). Also well known (and required in many states) are car seats for restraining babies while they are being transported in automobiles. Some of the prior art car seats have been made such that a parent can swivel or rotate the seat to a fixed locked position. Examples of such prior art devices are shown in U.S. Pat. No. 4,971,392 (also see FIG. 1 of the present application) and U.S. Pat. No. 4,781,412.

Thus, while the foregoing body of prior art indicates it to be well known to use baby walkers allowing babies to move themselves around and also fixed baby chairs in which the babies are restrained and cannot move, the provision of a more simple and cost effective device in which the baby is restrained from moving anywhere to a different location and yet can turn itself to look in any direction is not contemplated. Nor does the prior art described above teach or suggest a rotating baby chair device which may be used by parents to safely hold their children while allowing the child to spin around to face any direction to see what is going on around them. The foregoing disadvantages are overcome by the unique rotating baby chair of the present invention as will be made apparent from the following description thereof. Other advantages of the present invention over the prior art also will be rendered evident.

SUMMARY OF THE INVENTION

To achieve the foregoing and other advantages, the present invention, briefly described, provides a baby chair having an upper section to which a sling seat hangs and a lower base section to which legs are mounted in a tripod like construction, the upper section being able to rotate with respect to the lower base section and attached legs. The chair does not have wheels and thus while a child in the seat can spin himself (or herself) around to look in any direction, the child cannot move anywhere and since the legs are constructed to be angled out widely, there is no chance of the chair flipping over. A circular tray mounted around the perimeter of the upper section of the chair can be used to hold food and/or toys.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new rotating baby chair which has all of the advantages of the prior art and none of the disadvantages.

It is another object of the present invention to provide a new rotating baby chair which may be easily and efficiently manufactured and marketed.

It is a further objective of the present invention to provide a new rotating baby chair which is of durable and reliable construction.

An even further object of the present invention is to provide a new rotating baby chair which is susceptible of a low cost of manufacture with regard to both materials and labor, and which accordingly is then susceptible of low prices of sale to the consuming public, thereby making such rotating baby chair available to the buying public.

Still yet a further object of the present invention is to provide a new rotating baby chair having an upper section to which a sling seat hangs and a lower base section to which legs are mounted in a tripod like construction, the upper section being able to rotate with respect to the lower base section and attached legs.

It is still a further object of the present invention to provide a new rotating baby chair which does not have wheels and thus while a child in the seat of the chair can spin himself (or herself) around to look in any direction, the child cannot move anywhere and since the legs are constructed to be angled out widely, there is no chance of the chair flipping over.

Still a further object of the present invention is to provide a new rotating baby chair having a circular tray mounted around the perimeter of the upper section of the chair which can be used to hold food and/or toys.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is a perspective view showing the preferred embodiment of the rotating baby chair of the present invention.

FIG. 4 is a side view of the rotating baby chair of FIG. 1 in accordance with the present invention.

DESCRIPTION OF THE PREFERRED EMBODIMENT

Figure 1:
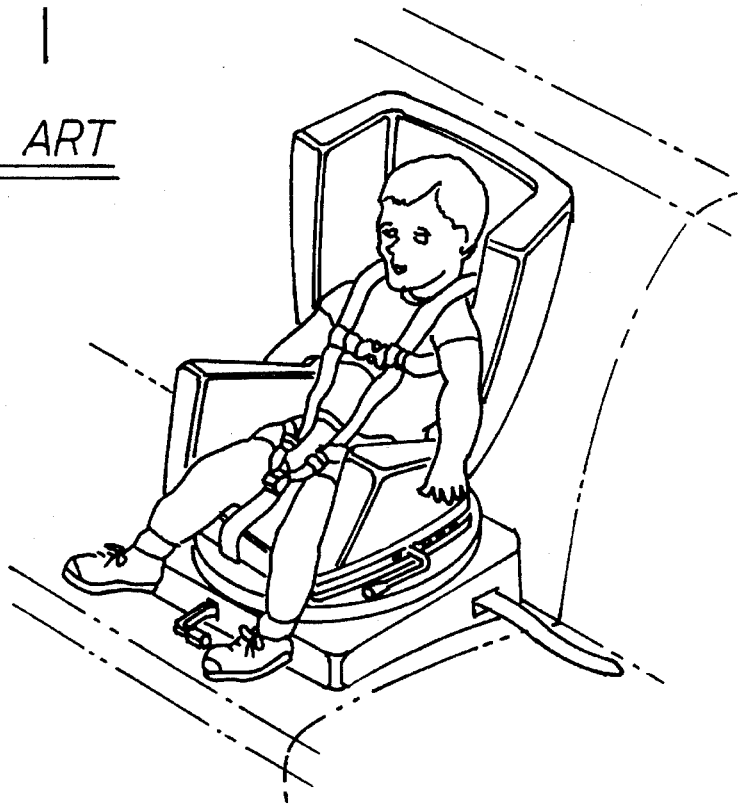
FIG 1 PRIOR ART
FIG. 1 is a perspective view showing a prior art child restraining device.
Figure 2:
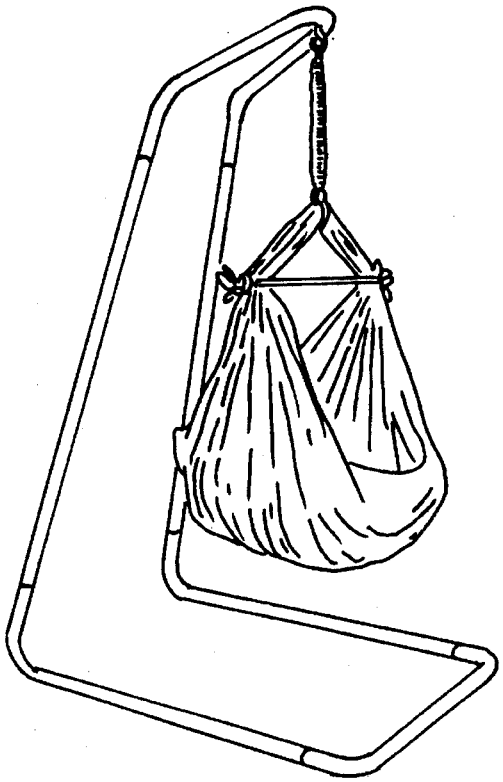
FIG 2 PRIOR ART
FIG. 2 is a perspective view of a second prior art child restraining device.

With reference now to the drawings, a new rotating baby chair embodying the principles and concepts of the present invention will be described.

Turning to FIGS. 3–7, there is shown an exemplary embodiment of the rotating baby chair of the present invention generally designated by reference numeral 20. In its preferred form, rotating baby chair 20 comprises generally a support structure of legs 50*a*, 50*b* and 50*c* supporting a circular tray 22 which itself supports a seat 30. The different pieces of the preferred embodiment of the present invention are best seen by reference to FIG. 7.

The tray 22 has a horizontal flat tray surface 24 and an outer vertical wall 26 and an inner vertical wall 28. The inner vertical wall 28 has a pair of pins 28*a*, 28*b*. On the bottom of the tray 22 is located a groove 25.

The seat 30 is preferably a sling type seat as shown in the Figures. An overhang section 32 of the seat 30 is constructed to be able to hang over the inner vertical wall 28 of the tray 22. A mounting bracket 34 having a pair of pin-holes 34*a*, 34*b* is preferably located on the front of the seat 30. The seat 30 has a pair of leg holes 36*a* and 36*b* for a baby's legs.

Figure 5:
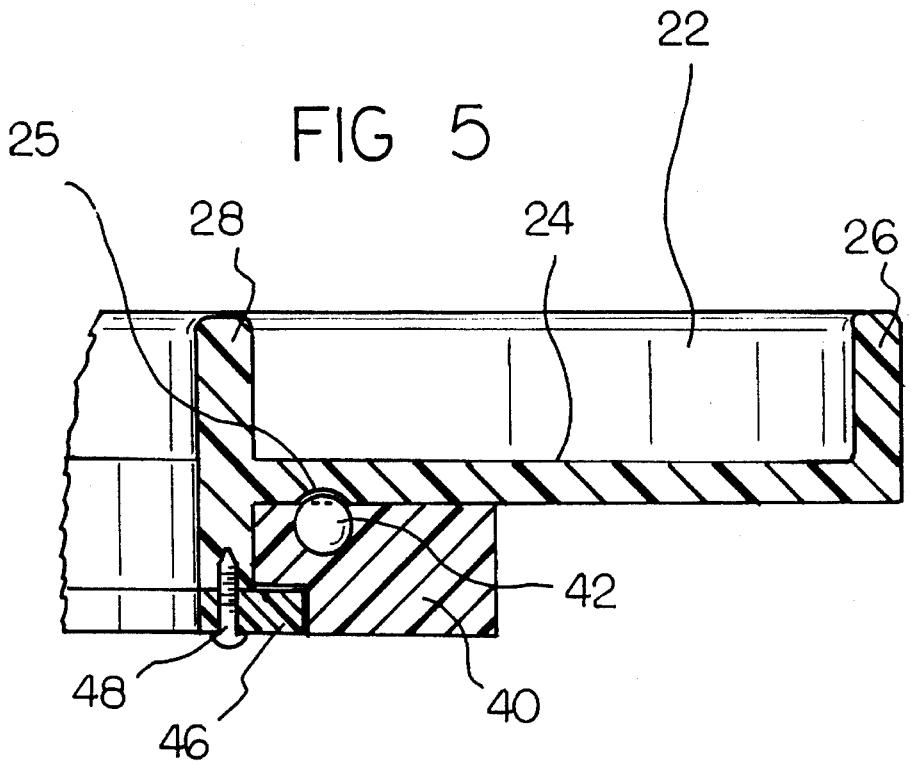
FIG. 5 is a cross-sectional view of the rotating baby chair of FIG. 3 taken along line 5—5 thereof in accordance with the present invention.
Figure 6:
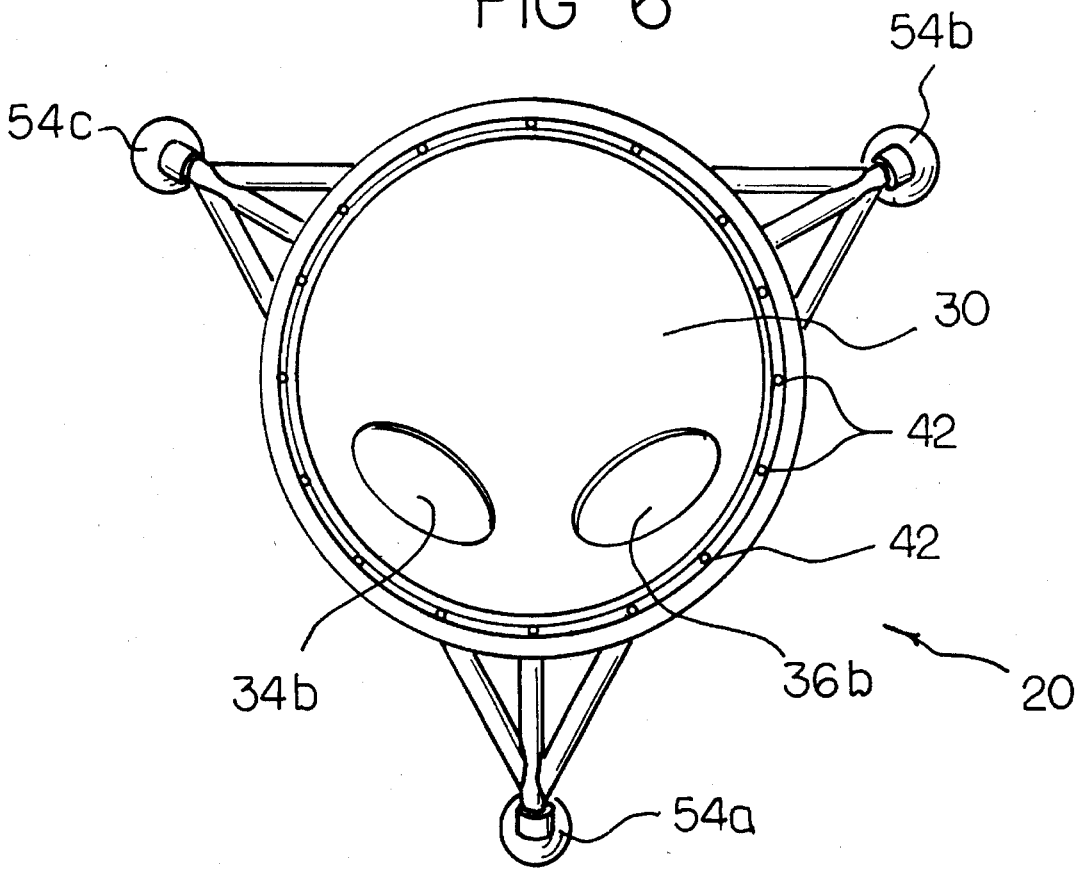
FIG. 6 is a perspective view from above taken along line 6—6 in FIG. 4 in accordance with the present invention.
Figure 7:
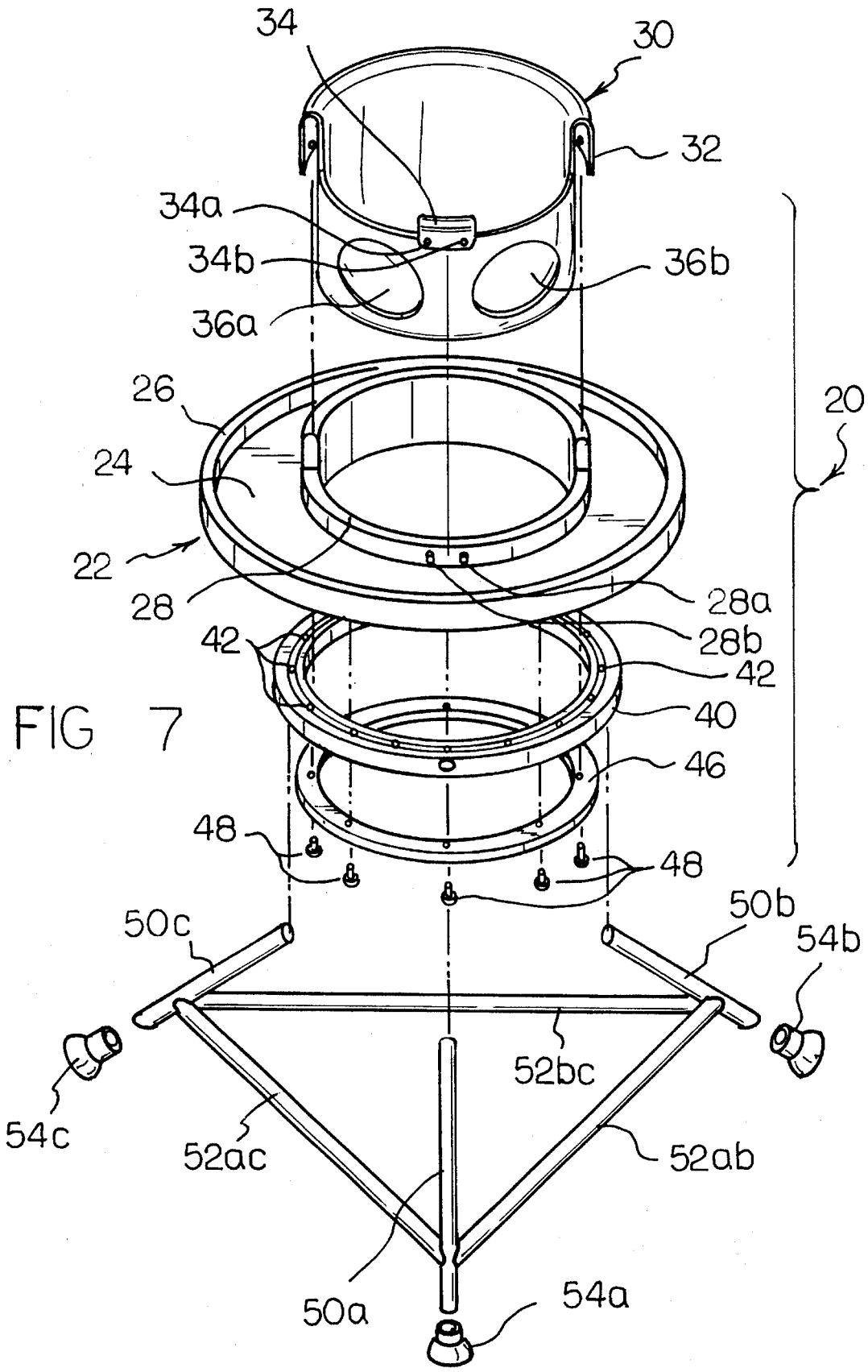
FIG. 7 is a perspective view of the rotating baby chair of FIG. 1 of the present invention shown with parts separated.

Now with particular reference to FIGS. 5 and 7, a bearing support ring 40 supporting a plurality of ball bearings 42 (preferably more than a dozen as shown-although only a few are labeled with reference numeral 42 in FIG. 7). The bearing support ring 40 is fixed to the legs 54*a*, 54*b* and 54*c* of the chair 20. The bearing support ring is constructed to mount under the tray 22 by means of a retainer ring 46. Screws 48 can be screwed through the retainer ring 46 and into the bottom of the inner vertical wall 28 of the tray 22. The bearing support ring 40 is sandwiched between the bottom of the tray 22 and the retainer ring 46. The ball bearings 42 are positioned in the groove 25 in the bottom of the tray 22.

The legs 50*a*, 50*b*, 50*c* which are fixed to the bearing support ring 40 are further supported by horizontal leg support cross bars/braces 52*ab*, 52*ac*, 52*bc*. Feet 54*a*, 54*b*, 54*c*, which are preferably rubber coated to prevent scratching floors, are mounted on the bottom of each of the legs 50*a*, 50*b* and 50*c* respectively. The legs 50*a*, 50*b*, and 50*c* are widely angled out to make a wide base for the chair 20 (wider than the base of baby walkers).

Use of the rotating baby chair 20 of the present invention is very easy. A baby can be positioned in the seat 30 and the seat can be positioned on the tray 22 by aligning holes 34*a* and 34*b* in the brace 34 on the seat 30 with pins 28*a* and 28*b* on the inner vertical wall 28, and then hanging overhang section 32 of the seat 30 over the inner vertical wall 28.

The tray 22 to which the seat 30 is mounted is constructed such that it can slide over the ball bearings 42 held within the bearing support ring 40. The groove 25 in the bottom of the tray 22 acts like a track which runs over the ball bearings 42. The bearing support ring 40 remains in the fixed in the same position since it is fixed to the legs 50*a*, 50*b* and 50*c*. Thus a child placed in the seat 22 can turn his or her self around three-hundred sixty degrees in either direction to face in any position by pushing against either the legs 50*a*, 50*b* and 50*c* of the chair 22 or the floor or the support cross bars 52*ab*, 52*ac*, and 52*bc*.

Since the chair of the present invention has no wheels, and is thus stationary, there is no possibility of a child getting away from the parents.

In an alternative embodiment, a locking means could also be added to the chair so that a parent could stop the chair from being able to rotate at appropriate times when the parent wants the child to only be able to face in one direction, such as dinner time.

In another alternative embodiment, a handrail means could be added which is fixed to the legs such that the child could use his or her arms to rotate his or herself.

The seat can be constructed such that it is height adjustable. Plastic hooks or the like could be added around the perimeter of the tray for hanging toys.

It is apparent from the above that the present invention accomplishes all of the objectives set forth by providing a new chair for a baby comprising: an upper section having attached thereto a seat for holding and restraining the baby; and a lower section having floor engaging means for securely maintaining the chair stable upright in a fixed position, the upper section constructed to rotate with respect to the lower section; whereby a baby restrained in the chair can spin itself around under its own power to look in any direction but cannot move the chair from a fixed position on the floor. The floor engaging means cab be a plurality of legs. The plurality of legs can be three legs spaced in a tripod-like fashion, the legs angled out widely to provide high stability. The seat can be a sling type seat. The invention can further comprise a tray means mounted on the chair for holding toys and/or food and the like. The tray means can be a circular tray which surrounds the perimeter of the seat of the chair.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A rotating baby chair comprising:

a tray having a center aperture extending through a center of said tray;

a seat means associated with said tray for supporting an infant relative to said tray and within said center aperture;

support structure means rotatably coupled to said tray for supporting said tray and said seat means relative to a ground surface;

and, rotation means interposed between said tray and said support structure, said rotation means for permitting said tray and said seat means to rotate relative to said support structure means about an axis directed through said center aperture, whereby said tray and said seat means rotate together, said rotation means comprising a first annular member of first diameter affixed to said support structure means and which forms an uppermost edge of said support structure means, said first annular member being oriented in a coaxial relation with respect to said axis, said tray comprising a second annular member of second diameter equal to or greater than said first diameter of said first annular member whereby the external periphery of said second annular member extends radially with respect to the external periphery of said first annular member.

2. The rotating baby chair of claim 1, wherein said tray includes a horizontal and circular flat tray surface, an outer vertical wall extending orthogonally upward from an exterior perimeter of said tray, and an inner vertical wall extending orthogonally upward from an interior perimeter of said tray and about said center aperture.

3. A rotating baby chair comprising:

a tray having a center aperture extending through a center of said tray;

a seat means associated with said tray for supporting an infant relative to said tray and within said center aperture;

support structure means rotatably coupled to said tray for supporting said tray and said seat means relative to a ground surface;

and, rotation means interposed between said tray and said support structure, said rotation means for permitting said tray and said seat means to rotate relative to said support structure means about an axis directed through said center aperture, whereby said tray and said seat means are adapted to rotate together, wherein said tray includes a horizontal and circular flat tray surface, an outer vertical wall extending orthogonally upward from an exterior perimeter of said tray, and an inner vertical wall extending orthogonally upward from an interior perimeter of said tray and about said center aperture, wherein said seat means comprises a sling type seat positioned within said center aperture of said tray, said sling type seat having an overhang section extending over and secured to said inner vertical wall of said tray, said seat having a pair of leg holes through which legs of said infant are adapted to extend.

4. The rotating baby chair of claim 3, wherein said support structure means comprises a plurality of legs fixedly supported by horizontal leg support cross bars extending between adjacent legs.

5. The rotating baby chair of claim 4, wherein said tray includes an annular groove extending around a bottom surface thereof; and further wherein said rotation means comprises a bearing support ring fixedly secured to said legs such that said support ring is aligned with said annular groove extending around said bottom surface of said tray; and a plurality of ball bearings disposed between said bearing support ring and said annular groove.

6. A rotating baby chair comprising:

a tray having a center aperture extending therethrough, said tray having a horizontal and circular flat tray surface, an outer vertical wall extending orthogonally upward from an exterior perimeter of said tray, and an inner vertical wall extending orthogonally upward from an interior perimeter of said tray and about said center aperture;

a seat means for supporting an infant relative to said tray and within said center aperture, said seat means comprising a sling type seat positioned within said center aperture of said tray, said sling type seat having an overhang section extending over and secured to said inner vertical wall of said tray, said seat having a pair of leg holes through which legs of said infant can extend;

support structure means rotatably coupled to said tray for supporting said tray relative to a ground surface, said support structure means comprising a plurality of legs fixedly supported by horizontal leg support cross bars extending between adjacent legs;

and, rotation means for permitting said tray and said seat means to rotate relative to said support structure means, whereby said tray and said seat means rotate together, said rotation means comprising a bearing support ring fixedly secured to said legs such that said support ring is aligned with said annular groove extending around said bottom surface of said tray; a plurality of ball bearings disposed between said bearing support ring and said annular groove; and a retainer ring mounted to said bottom surface of said tray and beneath said bearing support ring to preclude separation of said bearing support ring from adjacent positioning relative to said bottom surface of said tray.

7. The rotating baby chair of claim 6, and further comprising a plurality of feet, with each of said feet being coupled to a lower distal end of an individual one of said plurality of legs.

* * * * *